US005413408A

United States Patent [19]

Beck et al.

[11] Patent Number: 5,413,408

[45] Date of Patent: May 9, 1995

[54] FUME HOOD WITH PANEL RETENTION SYSTEM

[75] Inventors: Marshall K. Beck; John M. Bastian, both of Manitowoc, Wis.

[73] Assignee: Fisher Hamilton Scientific Inc., Two Rivers, Wis.

[21] Appl. No.: 195,909

[22] Filed: Feb. 14, 1994

Related U.S. Application Data

[63] Continuation of Ser. No. 947,775, Sep. 18, 1992, abandoned.

[51] Int. Cl.[6] ..... A47B 47/00

[52] U.S. Cl. ..... 312/263; 403/230

[58] Field of Search ..... 312/263; 403/68, 230–235, 403/289

[56] References Cited

U.S. PATENT DOCUMENTS

| | | | |
|---|---|---|---|
| 3,505,945 | 4/1970 | Greer | 98/115 |
| 3,759,004 | 9/1973 | Kent | 52/400 |
| 3,951,558 | 4/1976 | Komarov | 312/263 X |
| 3,956,977 | 5/1976 | Turko et al. | 98/115 |
| 3,989,156 | 11/1976 | Lowry | 312/263 X |
| 4,120,598 | 10/1978 | Zernig et al. | 312/263 X |
| 4,149,473 | 4/1979 | Lundqvist | 312/263 X |
| 4,199,907 | 4/1980 | Bains et al. | 52/125 |
| 4,208,850 | 6/1980 | Collier | 52/285 |
| 4,600,252 | 7/1986 | Barber | 312/263 |
| 4,621,877 | 11/1986 | Boudreau et al. | 312/263 X |
| 4,700,994 | 10/1987 | Röck et al. | 403/231 X |
| 4,744,612 | 5/1988 | Winter et al. | 403/289 |
| 4,815,798 | 3/1989 | Röck et al. | 312/330 R |
| 4,886,326 | 12/1989 | Kuzyk | 312/263 X |
| 4,909,581 | 3/1990 | Haheeb | 312/263 |

*Primary Examiner*—Stephen C. Pellegrino
*Assistant Examiner*—Nancy Mulcare
*Attorney, Agent, or Firm*—Tilton, Fallon, Lungmus & Chestnut

[57] ABSTRACT

A fume hood includes a housing with wall panels disposed in side-by-side relation and a top member disposed substantially perpendicularly to the wall panels. Connecting blocks which engage edge portions of adjacent panels connect these adjacent panels together. Clip members defining recesses for receiving edge portions of wall panels or of the top member secure the wall panels to the top member.

7 Claims, 1 Drawing Sheet

FUME HOOD WITH PANEL RETENTION SYSTEM

This application is a continuation of application Ser. No. 947,775, filed Sep. 18, 1992, now abandoned.

BACKGROUND OF THE INVENTION

1. Field of the Invention

The present invention relates to a fume hood with a panel retention system, and more particularly to a fume hood with a retention system which allows quick and easy assembly of the various panels of the fume hood housing.

2. Description of the Prior Art

Fume hoods typically include components for bringing utilities such as gas, compressed air, water and electricity to their working space. These components must be accessible for initial connection at the time of installation, inspection by code authorities for various municipalities, and maintenance and repair. Gaining access to these components of fume hoods is generally a difficult and time-consuming procedure.

The prior art includes a variety of fume hoods with complicated housings comprising close tolerance components which require accurate and expensive fabrication procedures as well as complicated and time-consuming assembly processes. Some of these fume hoods have unsightly access doors built into exterior panels to allow inspection of the various utility components disposed in the fume hood.

The fume hood of the present invention provides a simple housing structure with fasteners and connectors which allow quick and easy assembly and disassembly of the housing structure. It minimizes the number of fasteners used to secure the various panels of the housing together; and it provides a corrosion resistant enclosure. The fume hood of this invention is a simple construction which minimizes the expense of manufacture and assembly.

SUMMARY OF THE INVENTION

In accordance with one embodiment of this invention, a fume hood includes a housing defining a chamber with a front access opening. The housing includes a plurality of wall panels disposed in side-by-side relation. A ceiling panel lies substantially perpendicularly to the wall panels at one end of the panels.

Clip means connect the ceiling panel to the wall panels. Each of these clip means defines a recess for receiving one of the wall and ceiling panels. Screws or other securing means fixedly secure the clip means to the other of the wall and ceiling panels.

Connecting blocks secure adjacent wall panels together. Each block engages an edge portion of one panel and an edge portion of an adjacent panel, and securing devices such as screws secure the block to these edge portions.

BRIEF DESCRIPTION OF THE DRAWINGS

For a more complete understanding of the present invention, one should now refer to the embodiment illustrated in greater detail in the accompanying drawings and described below as an example of the invention. In the drawings.

While the following describes the invention in connection with one embodiment, one should understand that the invention is not limited to this embodiment. Furthermore, one should understand that the drawings are not to scale and that graphic symbols, diagrammatic representations, and fragmentary views may, in part, illustrate the embodiment. In certain instances, the disclosure may not include details which are not necessary for the understanding of the present invention.

DETAILED DESCRIPTION OF THE DRAWINGS

Figure 1:
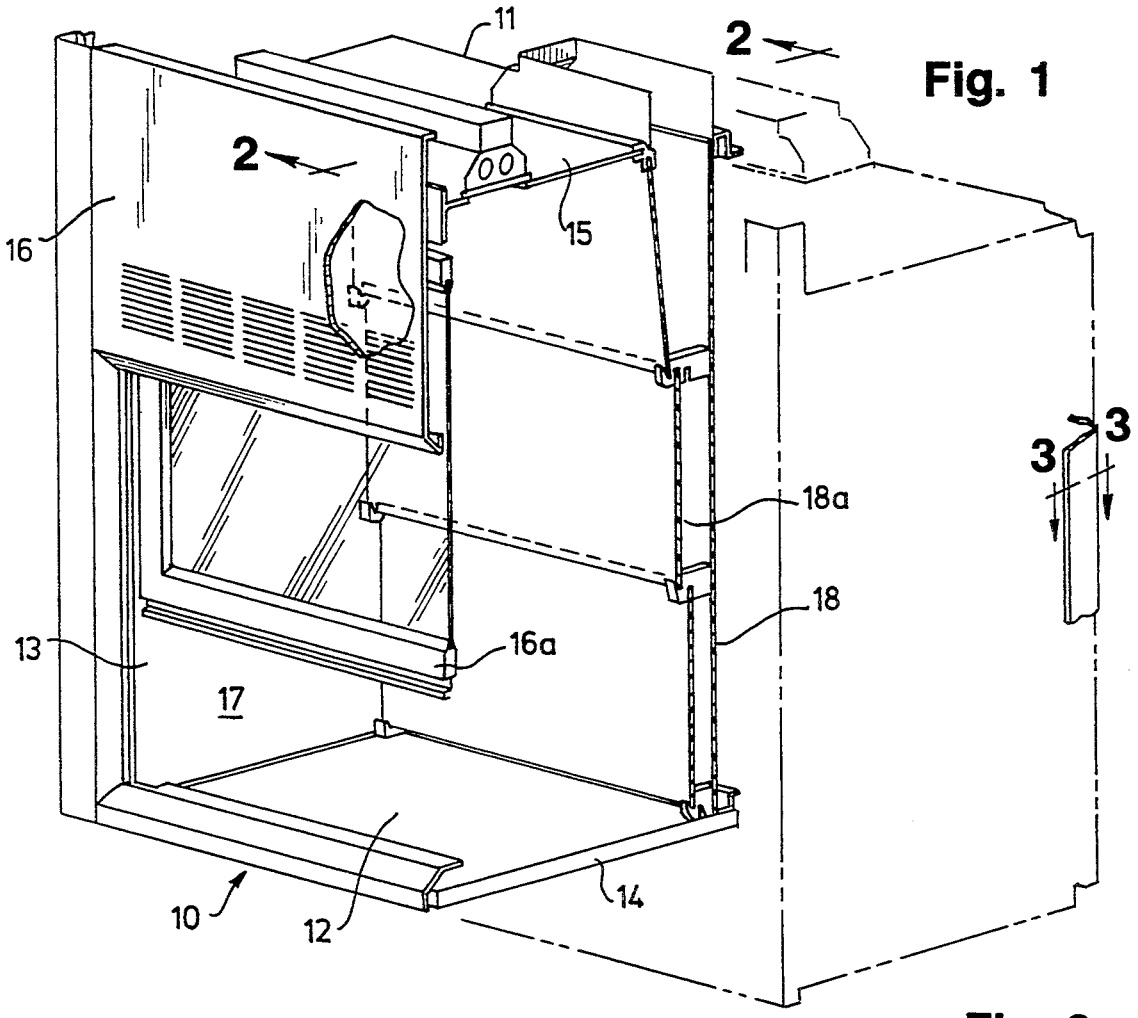
FIG. 1 is a perspective view of the fume hood of the present invention with a portion of the fume hood cut away.

In the illustration given and with reference to FIG. 1, the numeral 10 designates the fume hood of the present invention. This fume hood generally includes a housing 11 and a blower (not shown). The housing defines a chamber 12 with a front opening 13 and comprises a base 14, a ceiling panel 15, a front panel 16, side panels 17, a rear panel 18, and a baffle assembly 18*a*. A sash 16*a*, slidably mounted to the housing 11 opens and closes the opening 13.

The panels and other members identified above are members made out of metal, hard plastic, or any other material of sufficient strength, rigidity and corrosion resistance. The panels which define the chamber 12 and the baffle plates are made of cement board or a polyester material. Alternatively, they may be polyvinyl chloride, polypropylene, or any other suitable material. They, as well as the fasteners described below, resist the chemical action of fumes in the chamber 12.

Clip members 19 and 20 secure the front, side and rear panels to the ceiling panel 15. The clip member 19 secures the ceiling panel 15 to the front panel 16; and the clip members 20 secure the ceiling panel 15 to the rear panels 18 and the side panels 17. The clip member 19 is a resilient thermoplastic material (e.g., polyvinyl chloride) formed to define a recess 21 which receives an edge portion of the ceiling panel 15. Screws 22 or similar securing means secure the clip member 19 to the front panel 16 between the front panel and a rigid (e.g., metallic) strip 23.

Figure 2:
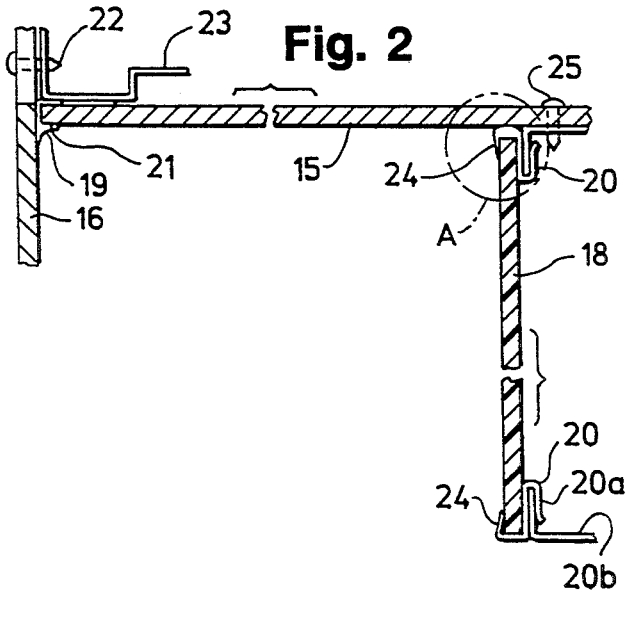
FIG. 2 is a sectional view taken along line 2—2 in FIG. 1.

Each clip member 20 is a two piece structure, a clipping portion 20*a* made of the same material as the clip member 19 and a rigid portion 20*b* made of metal such as steel or any other rigid material of high strength. Each one includes a recess 24 which receives an edge portion of a wall panel (panel 18 in FIG.2). Screws 25 or similar securing devices fixedly secure the portions 20*b* of the clip members 20 to the ceiling panel 15 or the base 14.

The cross-sectional configuration of each recess 21 and 24 is trapezoidal with the entrance to the recess having a smaller width than the width at the bottom of the recess. The width of the entrance to the recess is also smaller than the thickness of the wall panel which the recess receives so that the clip may engage the panel in a press-fit. This feature also allows the use of panels with different thickness.

Figure 3:
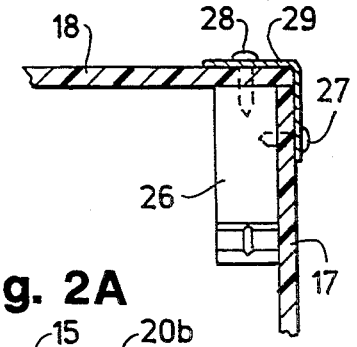
FIG. 3 is a sectional view taken along line 3—3 in FIG. 1.
Figure 2A:
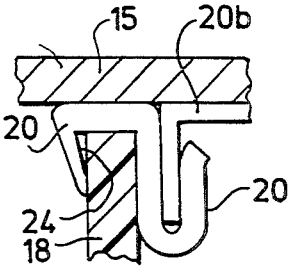
FIG. 2A is an enlarged view of detail A in FIG. 2.

Block members 26 are made of hard plastic (e.g., polyester), metal, or any other material of high strength, rigidity, and corrosion resistance and secure adjacent wall panels together. The block 26 shown in FIG. 3 connects a side panel 17 with the rear panel 18. It engages both the panel 17 and the panel 18. A screw 27 secures an edge portion of the panel 17 to the portion of the block 26 which engages the panel 17; and a screw 28 secures an edge portion of the panel 18 to the portion of the block 26 which engages the panel 18. An angle strip 29 which extends from the bottom of the base 14 to the ceiling panel 15 serves as a corner treatment at the connection between the panels 17 and 18. Suitable connecting devices such as nuts and bolts secure this strip 29 to the L-shaped portions 20*b* of the clip members 20.

While the applicant has shown one embodiment of the present invention, one will understand, of course, that the invention is not limited to this embodiment, as those skilled in the art to which the invention pertains may make modifications and other embodiments of the principles of the invention, particularly upon considering the foregoing teachings. The applicant, therefore, by the appended claims, intends to cover any modifications and other embodiments which incorporate those features which constitute the essential features of this invention.

What is claimed is:

1. A fume hood comprising: a housing having an interior chamber with a front opening which allows access to the chamber, said housing including: a base member; a plurality of wall panels disposed substantially perpendicularly to the base member; a ceiling panel disposed substantially perpendicularly to the wall panels; said wall panels extending between the base member and the ceiling panel; first connecting means for securing the ceiling panel to a wall panel, said first connecting means including clip means with a resilient portion which defines a recess for receiving an edge portion of one of either said wall panel or the ceiling panel and first securing means for securing the clip means to the other one of the ceiling panel or said wall panel, said clip means receiving an edge portion of only one of either said wall panel or the ceiling panel; and second connecting means for connecting adjacent wall panels together, said second connecting means including block members for engaging adjacent edge portions of adjacent panels and second securing means for securing the block members to the adjacent edge portions.

2. A fume hood comprising: a housing having an interior chamber with a front opening which allows access to the chamber, said housing including: a base member; a plurality of wall panels disposed substantially perpendicularly to the base member; a ceiling panel disposed substantially perpendicularly to the wall panels; said wall panels extending between the base member and the ceiling panel; first connecting means for securing the ceiling panel to a wall panel, said first connecting means including clip means defining a recess for receiving an edge portion of one of either said wall panel or the ceiling panel and first securing means for securing the clip means to the other one of the ceiling panel or said wall panel; second connecting means for connecting adjacent wall panels together, said second connecting means including block members for engaging adjacent edge portions of adjacent panels and second securing means for securing the block members to the adjacent edge portions.

3. The fume hood of claim 2, wherein the block members engage inside surfaces of adjacent edge portions of adjacent wall panels.

4. The fume hood of claim 2, wherein the first and second securing means for the block and clip members includes screws.

5. The fume hood of claim 2, wherein adjacent wall panels lie perpendicularly to one another.

6. The fume hood of claim 2, further comprising a base member disposed substantially perpendicularly to the wall panels at an opposite end of the wall panels, said base member being secured to the wall panels by the first connecting means.

7. The fume hood of claim 2, wherein the clip means includes a two piece clip member with a resilient portion defining the recess and a rigid portion releasably secured to the resilient portion, the securing means securing the rigid portion.

* * * * *